US008197182B2

(12) United States Patent
Hernandez

(10) Patent No.: US 8,197,182 B2
(45) Date of Patent: Jun. 12, 2012

(54) OPPOSED FLOW HIGH PRESSURE-LOW PRESSURE STEAM TURBINE

(75) Inventor: Nestor Hernandez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 840 days.

(21) Appl. No.: 12/342,570

(22) Filed: Dec. 23, 2008

(65) Prior Publication Data

US 2010/0158666 A1 Jun. 24, 2010

(51) Int. Cl.
*F01D 3/02* (2006.01)

(52) U.S. Cl. ..... 415/93

(58) Field of Classification Search ..... 415/93, 415/101, 1, 17, 36, 108, 191, 198.1
See application file for complete search history.

(56) References Cited

U.S. PATENT DOCUMENTS

| | | | | |
|---|---|---|---|---|
| 4,577,281 | A * | 3/1986 | Bukowski et al. | 700/289 |
| 4,961,310 | A | 10/1990 | Moore et al. | |
| 5,411,365 | A | 5/1995 | Mazzola et al. | |
| 5,993,173 | A * | 11/1999 | Koike et al. | 417/407 |
| 6,203,274 | B1 * | 3/2001 | Kikuchi et al. | 415/191 |
| 6,332,754 | B1 * | 12/2001 | Matsuda et al. | 415/191 |
| 2007/0258826 | A1 | 11/2007 | Bracken et al. | |
| 2008/0050226 | A1 | 2/2008 | Bracken et al. | |

* cited by examiner

*Primary Examiner* — Alexander Gilman
(74) *Attorney, Agent, or Firm* — Cantor Colburn LLP

(57) ABSTRACT

An opposed flow high pressure-low pressure steam turbine balances thrust of the high pressure steam turbine with the thrust of the low pressure steam turbine allowing a reduction in size of thrust bearings. Higher stage reactions in both turbines may be incorporated since they are offset with the opposed flow, allowing a higher steam path efficiency. Opposed flow may be established through a cross-over pipe or utilizing a double high pressure shell.

11 Claims, 4 Drawing Sheets

OPPOSED FLOW HIGH PRESSURE-LOW PRESSURE STEAM TURBINE

BACKGROUND OF THE INVENTION

The invention relates generally to steam turbines and more specifically to steam flow arrangements within the steam turbines to minimize thrust.

Today, large steam turbines are often used for large combined cycle power systems having a steam turbine and gas turbine, together driving an electrical generator as the load. Many arrangements for gas turbines and steam turbines in a combined cycle have been proposed. A combined cycle is an integrated thermal cycle, wherein the hot exhaust gas from a combustion gas turbine contributes heat energy to partially or wholly generate the steam used in the steam turbine.

A steam turbine is a mechanical device that extracts energy from pressurized steam, and converts the energy into useful work. Steam turbines receive a steam flow at an inlet pressure through multiple stationary nozzles that direct the steam flow against buckets rotationally attached to a rotor of the turbine. The steam flow impinging on the buckets creates a torque that causes the rotor of the turbine to rotate, thereby creating a useful source of power for turning an electrical generator or the like. The steam turbine includes, along the length of the rotor, multiple pairs of nozzles (or fixed blades) and buckets. Each pair of nozzle and bucket is called a stage. Each stage extracts a certain amount of energy from the steam flow causing the steam pressure to drop and the specific volume of the steam flow to expand. Consequently, the size of the nozzles and the buckets (stages) and their distance from the rotor grow progressively larger in the later stages. For cost and efficiency purposes, it is generally desired to extract the most energy possible before discharging the exhausted steam flow to a vacuum in a condenser.

In large power steam turbines, the number and diameter of the stages become massive. Usually, it is desired to separate the energy extraction process into two separate turbines, referred to as a high pressure steam turbine and a low pressure steam turbine. The high pressure steam turbine accepts the initial steam flow at a high pressure and exhausts into a low pressure steam turbine that continues the energy extraction process. The high pressure steam turbine must be constructed to withstand the greater forces created by the high pressure steam. The low pressure steam turbine must be larger to accommodate the large specific volume of the steam at reduced pressure.

Steam turbines may further be classified with regard to the action of the steam in conversion from heat to mechanical energy. The energy transfer may occur by an impulse mechanism, a reaction mechanism or a combination of the two. An impulse turbine has fixed nozzles that orient the steam flow into high speed jets. These jets contain significant kinetic energy, which the buckets, convert into shaft rotation as the steam jet changes direction. A pressure drop occurs across only the stationary blades, with a net increase in steam velocity across the stage.

In the reaction turbine, the rotor blades themselves are arranged to form convergent nozzles. This type of turbine makes use of the reaction force produced as the steam accelerates through the nozzles formed by the rotor. Steam is directed onto the rotor by the fixed vanes of the stator. It leaves the stator as a jet that fills the entire circumference of the rotor. The steam then changes direction and increases its speed relative to the speed of the blades. A pressure drop occurs across both the stator and the rotor, with steam accelerating through the stator and decelerating through the rotor, with no net change in steam velocity across the stage but with a decrease in both pressure and temperature, reflecting the work performed in the driving of the rotor. Historically, full advantage has not been taken of the reaction mechanism in extracting energy from the steam turbine, in part because turbine performance was considered adequate and in in part due to difficulty in responding to increased axial thrust on the rotor shaft resulting from increased reaction forces on the moving blades.

Increased fuel costs and a desire by customers for improved steam turbine performance has raised interest in driving increased efficiency through a higher reaction output. For example, single flow HP-LP steam turbines are frequently used for desalination plants, where these plants are located in places where fuel is relatively cheap. Even so, with current fuel prices, performance is becoming an important parameter even for these applications. Performance expense for these type plants went from $300/kw to $800/kW in the last 2/3 years, highlighting the current emphasis on improved performance.

A conventional arrangement for a single flow high pressure-low pressure (HP-LP) steam turbine is illustrated in FIG. 1. A flow path for a HP-LP steam turbine may be defined as the steam flow among turbine units supported between a pair of journal bearings. In a single flow HP-LP steam turbine 5, the current orientation is to have the HP turbine 10 first followed by the LP turbine 20, both aligned in the same direction and connected by a vertical joint 25. The common rotor shaft 30 of the HP-LP turbine 5 may be supported by journal bearings 35 at opposing ends. Axial HP steam flow 50 passes through vertical joint 25 and axial LP steam flow 55 pass through the HP-LP steam turbine 5 in the same direction creating HP thrust 60 and LP thrust 65 resulting in an additive net thrust 70. Further, one large combined thrust bearing 40 may be provided may be provided at an end of the common rotor shaft 30 to absorb the combined net thrust 70 of the HP turbine 10 and the LP turbine 20. In many cases, the combined thrust bearing 40 is sized as large as is possible for the application.

The problem of large axial thrust was previously solved by using a large thrust bearing and low reaction levels in the steam turbine design. This is not a good performance combination as large thrust bearing means large bearing losses and low reaction means low steam path performance. Such configurations have none or very little performance room to improve.

If the steam path performance is to be improved, the major source of improvement left available is to increase stage reaction in either, or both, the HP and LP turbines. Increased stage reaction, however, leads to increased thrust loads necessitating greater thrust handling capability (reflected in greater size of the thrust bearing). In some applications with single flow HP-LP steam turbine units, current units already use the largest size special purpose bearing available. The size of the thrust bearings already restrict the performance of HP-LP single flow units forcing a low reaction steam path design around 5%.

Accordingly, there is a need to provide an arrangement for a HP steam turbine and a LP steam turbine combination to advantageously limit thrust, so an overall steam path efficiency may be improved by increasing stage reaction.

BRIEF DESCRIPTION OF THE INVENTION

The present invention relates to an arrangement for a HP steam turbine and a LP steam turbine combination to advantageously limit thrust, so an overall steam path efficiency for the combination may be improved by increasing stage reaction. Briefly in accordance with one aspect an opposed flow steam turbine is provided. The opposed flow steam turbine includes a high pressure steam turbine and a low pressure steam turbine. A rotor shaft is provided common to the high pressure steam turbine and the low pressure steam turbine. A first steam flow path is provided through the high pressure steam turbine. A second steam flow path is provided in an opposing direction through the low pressure steam turbine. Means are provided for directing the first steam flow path from the high pressure steam turbine to the second steam flow path in an opposing direction through the low pressure steam turbine.

According to a second aspect of the present invention, a method for arranging steam flow path in a opposed flow high pressure-low pressure steam turbine is provided. The method includes arranging a a high pressure steam turbine and a low pressure steam turbine on a common rotor shaft. The method further includes directing a first steam flow path through the high pressure steam turbine, directing a second steam flow path in an opposing direction through the low pressure steam turbine, and directing the steam flow path exiting from the high pressure steam turbine to an inlet for the second steam flow path in an opposing direction through the low pressure steam turbine.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including providing an opposed flow high pressure-low pressure steam turbine that balances thrust of the high pressure steam turbine with the thrust of the low pressure steam turbine allowing a reduction in size of thrust bearings. Higher stage reactions in both turbines may be incorporated since they are offset with the opposed flow, allowing a higher steam path efficiency. Opposed flow may be established through a cross-over pipe or utilizing a double high pressure shell. Analysis suggests a potential increase in HP steam path efficiency of at least 2% percent and an overall thrust load reduction of about 40%.

Figure 2:
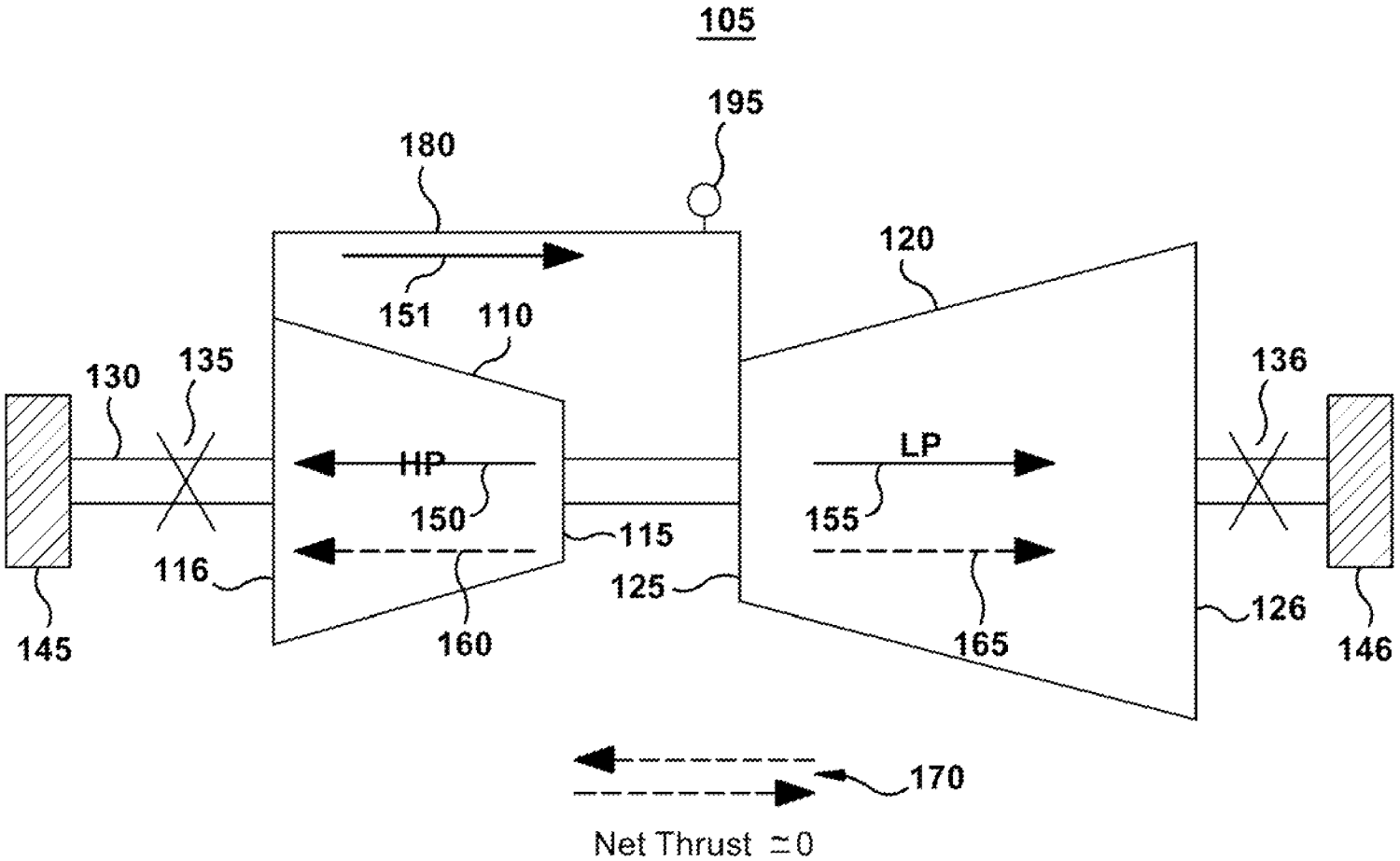
FIG. 2 illustrates a first embodiment of the opposing flow HP-LP steam turbine with a cross-over pipe for redirecting flow.

FIG. 2 illustrates one embodiment of the opposed flow steam turbine. The opposed flow steam turbine 105 includes a HP steam turbine 110 and a LP steam turbine 120. A rotor shaft 130 is provided common to the HP steam turbine and the LP steam turbine. A first steam flow path 150 is provided through the HP steam turbine 110. A second steam flow path 155 is provided in an opposing direction through the LP steam turbine 120. Means 80 are also provided for directing the first steam flow 150 path 150 from the HP steam turbine 110 to the second steam flow path 155 in an opposing direction through the LP steam turbine 120. In this first embodiment of the present invention, means may include a cross-over pipe for delivery of steam from the LP end 116 of the HP steam turbine 110 to the HP end 125 of the LP steam turbine 120.

Bearing supports are provided for the opposed flow steam turbine 105 including a journal bearing 135 at a low pressure end 116 of the HP steam turbine 110 and a journal bearing 136 at a low pressure end 126 of the LP steam turbine 120. A first thrust bearing 145 is provided at the low pressure end 116 of the HP steam turbine 110. A second thrust bearing 146 is provided at the low pressure end 125 of the LP steam turbine 120. A thrust 160 exerted by the HP steam turbine 130 and a thrust 170 exerted by the LP steam turbine 120 on the common rotor 130 are nominally designed to be approximately of the same magnitude and of opposite direction. A net thrust 180 would ideally have a magnitude of zero, however the thrust exerted by the two turbines cannot be perfectly balanced over the full load range, so a small, non-zero net thrust 180 does exist. Therefore, thrust bearings 145, 146 at opposing ends of the HP-LP turbine, need be sized to receive the small non-zero thrust rather than the combined additive thrust load of the single flow HP-LP turbine.

In the single flow HP-LP steam turbine, added thrust could not be accommodated. With the opposing flow steam turbine, the balancing of thrust with the opposing steam flows in the HP steam turbine and the LP steam turbine, allows increased thrust on one or both individual turbines to be accepted. Therefore, the individual HP and LP steam turbines may be designed with an elevated reaction leading to a higher efficiency steam path.

Figure 3:
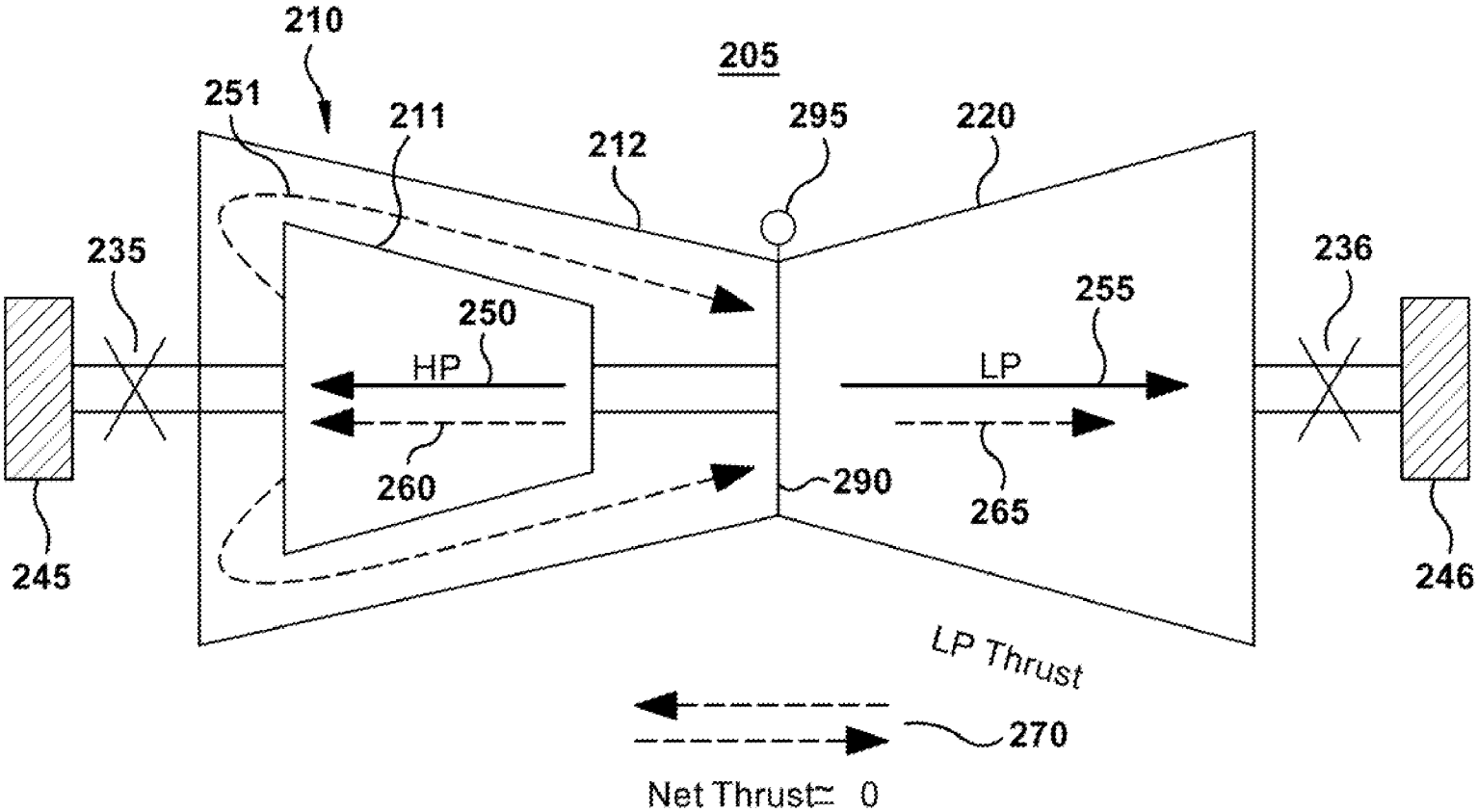
FIG. 3 illustrates a second embodiment of the opposing flow HP-LP steam turbine with a double shell on the HP turbine for redirecting flow.

A second embodiment of the opposed flow HP-LP steam turbine is illustrated in FIG. 3. The second embodiment for the HP-LP steam turbine 305 includes arrangements of thrust bearings 245, 246 and journal bearings 235, 236 similar to that of the first embodiment. The HP turbine includes means for directing the first steam flow path from the high pressure steam turbine to the second steam flow path in an opposing direction through the low pressure steam turbine. These means include an inner shell 211 on the HP steam turbine 210, adapted for providing a first steam flow path 250 through the HP steam turbine. An outer shell 212 redirects the first flow the high pressure side to the low pressure side through the high pressure steam turbine, back in the opposing direction 251 and to a vertical casing joint 290 between the HP steam turbine and the LP steam turbine.

The casing joint 290 is adapted to receive the cross-over steam flow 251 from the outer shell 212 of the HP steam turbine 210 into the steam flow path 155 for the LP steam turbine 220.

Figure 1:
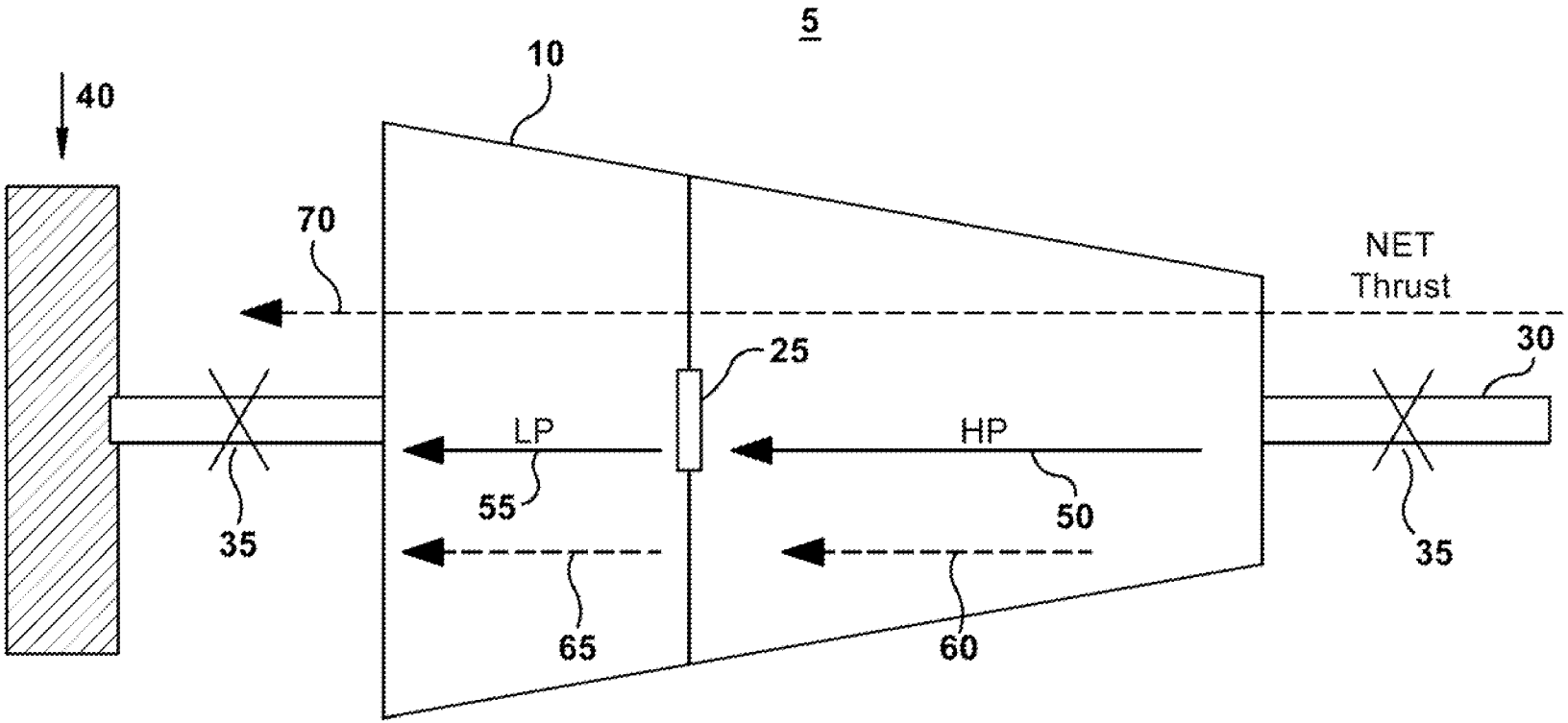
FIG. 1 (Prior Art)
FIG. 1 illustrates a conventional arrangement for a single flow high pressure-low pressure (HP-LP) steam turbine.

The embodiments of both FIG. 2 and FIG. 3 both provide a further advantage over the single flow HP-LP steam turbine 5 by providing advantageous monitoring of the steam flow between the HP and LP turbines. Restricted placement of instruments in the vertical joint 25 (FIG. 1) of the single flow HP-LP steam turbine may not allow representative measurement of the flow passing through the joint. In the inventive embodiments, instrumentation may be provided on the cross-over steam flow path 151, 251 for the opposing flow HP-LP steam turbine, adapted for monitoring a plurality of steam flow parameters. Sensors 195, 295 for temperature, pressure, flow, etc. may be could be placed in the crossover pipe 180 (FIG. 2) or at the casing joint 290 (FIG. 2). Broad mixing of the flow occurs in both the cross-over pipe and the flow through outer shell, 212 upstream of allowing for more accurate measurements to be taken at the exhaust of the HP section since the steam would be mixed and the temperature profile created by the steam path expansion would be eliminated or reduced. More accurate measurement of these parameters allows for better control of overall turbine operation.

Figure 4:
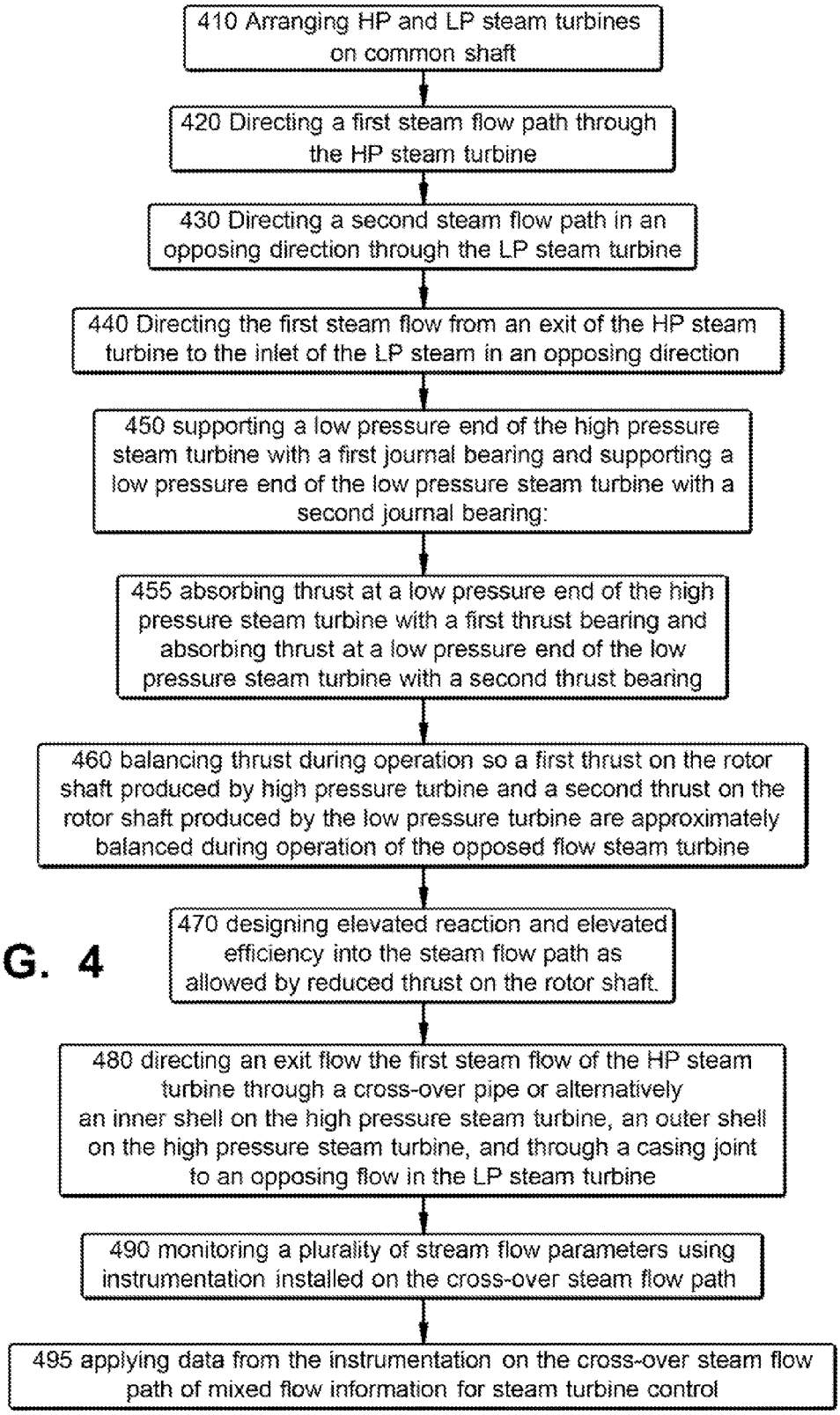
FIG. 4 illustrates a flow chart for arranging steam flow path in an opposed flow high pressure-low pressure steam turbine.

FIG. 4 illustrates a flow chart for arranging steam flow path in an opposed flow HP-LP steam turbine. Step 410 arranges an HP steam turbine and an LP steam turbine on a common rotor shaft. Step 420 provides for directing a first steam flow path through the HP steam turbine. In step 430, a second steam flow path is directed in an opposing direction through the LP steam turbine. In step 440, the first steam flow path may be directed from an exit of the HP steam turbine to the inlet of the LP steam turbine in an opposing direction.

The method further includes the step 450 of supporting a LP end of the HP steam turbine with a first journal bearing and supporting a LP end of the LP steam turbine with a second journal bearing. Step 455 includes absorbing thrust at a LP end of the HP steam turbine with a first thrust bearing and absorbing thrust at a LP end of the LP steam turbine with a second thrust bearing.

The method also provides for step 460 of balancing thrust during operation so a first thrust on the rotor shaft produced by the HP turbine and a second thrust on the rotor shaft produced by the LP turbine are approximately balanced during operation of the opposed flow steam turbine. Step 470 incorporates designing elevated reaction and elevated efficiency into the steam flow path as allowed by reduced thrust on the rotor shaft.

In step 480, the method directs an exit flow the first steam flow of the HP steam turbine through a cross-over pipe to the second steam flow in the LP steam turbine or alternatively directing the first steam flow path from the HP steam turbine to the second steam flow path in an opposing direction through the LP steam turbine in a path including an inner shell on the HP steam turbine, an outer shell on the HP steam turbine, and through a casing joint between the HP steam turbine and the LP steam turbine, adapted to receive the cross-over steam flow from the outer shell of the LP steam turbine.

Step 490 provides for monitoring a plurality of steam flow parameters using instrumentation installed on the cross-over steam flow path between the HP steam turbine and the LP steam turbine. Step 495 includes enhancing performance from the opposed flow high pressure-LP steam turbine by applying data from the instrumentation on the cross-over steam flow path of mixed flow information for steam turbine control.

While various embodiments are described herein, it will be appreciated from the specification that various combinations of elements, variations or improvements therein may be made, and are within the scope of the invention.

The invention claimed is:

1. An opposed flow steam turbine comprising:
- a high pressure steam turbine;
- a low pressure steam turbine;
- a rotor shaft common to the high pressure steam turbine and the low pressure steam turbine;
- a first steam flow path in a first direction through the high pressure steam turbine;
- a second steam flow path in an opposing direction through the low pressure steam turbine; and
- means for directing the first steam flow path from the high pressure steam turbine to the second steam flow path in an opposing direction through the low pressure steam turbine, wherein the means comprises:
  - an inner shell on the high pressure steam turbine, adapted for providing a first steam flow path in a first direction through the high pressure steam turbine;
  - the first steam flow path in the first direction through the inner shell of the high pressure steam turbine;
  - an outer shell on the high pressure steam turbine;
  - a cross-over steam flow through the outer shell on the high pressure steam turbine to the low pressure steam turbine; and
  - a casing joint between the high pressure steam turbine and the low pressure steam turbine, adapted to receive the cross-over steam flow from the outer shell of the high pressure steam turbine.

2. The opposed flow steam turbine according to claim 1, further comprising: a bearing support system for the opposed flow steam turbine including a journal bearing at a low pressure end of the high pressure steam turbine; a journal bearing at a low pressure end of the low pressure steam turbine; a first thrust bearing at the low pressure end of the high pressure steam turbine; and a second thrust bearing at the low pressure end of the low pressure steam turbine.

3. The opposed flow steam turbine according to claim 2, wherein means are provided for approximately balancing a first thrust on the rotor shaft produced by the high pressure turbine and a second thrust on the rotor shaft produced by the low pressure turbine during operation of the opposed flow steam turbine.

4. The opposed flow steam turbine according to claim 3, wherein the first thrust bearing and the second thrust bearing are rated for reduced thrust based on the approximate balancing of thrust from the opposed flow of the high pressure steam turbine and the low pressure steam turbine.

5. The opposed flow steam turbine according to claim 4, wherein the approximate balancing of thrust allows a high reaction and high efficiency steam path.

6. An opposed flow steam turbine comprising:
- a high pressure steam turbine;
- a low pressure steam turbine;
- a rotor shaft common to the high pressure steam turbine and the low pressure steam turbine;
- a first steam flow path in a first direction through the high pressure steam turbine;
- a second steam flow path in an opposing direction through the low pressure steam turbine;
- means for directing the first steam flow path from the high pressure steam turbine to the second steam flow path in an opposing direction through the low pressure steam turbine, wherein the means comprises: a cross-over pipe from a steam outlet for the high pressure steam turbine to a steam inlet for the low pressure steam turbine; and a cross-over steam flow through the cross-over pipe from the high pressure steam turbine to the low pressure steam turbine;
- instrumentation on the cross-over steam flow path between the high pressure steam turbine and the low pressure steam turbine, adapted for monitoring a plurality of steam flow parameters, wherein data from the instrumentation on the cross-over steam flow path comprises mixed flow information for steam turbine control; and
- instrumentation on the cross-over steam flow path between the high pressure steam turbine and the low pressure steam turbine, adapted for monitoring a plurality of steam flow parameters.

7. A method for arranging steam flow path in an opposed flow high pressure-low pressure steam turbine comprising:
- arranging a high pressure steam turbine and a low pressure steam turbine on a common rotor shaft;
- directing a first steam flow path in a first direction through the high pressure steam turbine;

directing a second steam flow path in an opposing direction through the low pressure steam turbine;

directing the first steam flow path from the high pressure steam turbine to the second steam flow path in an opposing direction through the low pressure steam turbine;

supporting a low pressure end of the high pressure steam turbine with a first journal bearing;

supporting a low pressure end of the low pressure steam turbine with a second journal bearing;

absorbing thrust at a low pressure end of the high pressure steam turbine with a first thrust bearing;

absorbing thrust at a low pressure end of the low pressure steam turbine with a second thrust bearing;

wherein a first thrust on the rotor shaft produced by the high pressure turbine and a second thrust on the rotor shaft produced by the low pressure turbine are approximately balanced during operation of the opposed flow steam turbine; and directing the first steam flow path from the high pressure steam turbine to the second steam flow path in an opposing direction through the low pressure steam turbine in a path including an inner shell on the high pressure steam turbine, an outer shell on the high pressure steam turbine, and through a casing joint between the high pressure steam turbine and the low pressure steam turbine, adapted to receive the cross-over steam flow from the outer shell of the low pressure steam turbine.

8. The method for arranging steam flow path in an opposed flow high pressure-low-pressure steam turbine according to claim 7, incorporating elevated reaction and elevated efficiency into the steam flow path as allowed by reduced thrust on the rotor shaft.

9. The opposed flow steam turbine according to claim 7, further comprising: directing an exit flow the first steam flow of the high pressure steam turbine through a cross-over pipe to the second steam flow in the low pressure steam turbine.

10. The method for arranging steam flow path in a opposed flow high pressure-low pressure steam turbine according to claim 9, further comprising: monitoring a plurality of steam flow parameters using instrumentation on the cross-over steam flow path between the high pressure steam turbine and the low pressure steam turbine.

11. The method for arranging steam flow path in a opposed flow high pressure-low pressure steam turbine according to claim 10, comprising: enhancing performance from the opposed flow high pressure-low pressure steam turbine by applying data from the instrumentation on the cross-over steam flow path of mixed flow information for steam turbine control.

* * * * *